US007602343B2

(12) United States Patent
Takada et al.

(10) Patent No.: US 7,602,343 B2
(45) Date of Patent: Oct. 13, 2009

(54) ANTENNA

(75) Inventors: Yoshinao Takada, Tokyo (JP); Daisuke Nozue, Kanagawa (JP); Hiroshi Ikeda, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 167 days.

(21) Appl. No.: 11/937,251

(22) Filed: Nov. 8, 2007

(65) Prior Publication Data

US 2008/0111745 A1 May 15, 2008

(30) Foreign Application Priority Data

Nov. 9, 2006 (JP) ..... 2006-303832

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

| | | | |
|---|---|---|---|
| 2003/0058177 A1 | 3/2003 | Nishikido et al. | |
| 2004/0125030 A1 | 7/2004 | Sung et al. | |
| 2005/0270238 A1 | 12/2005 | Jo et al. | |
| 2006/0139211 A1 | 6/2006 | Vance et al. | |
| 2007/0018896 A1 * | 1/2007 | Chen et al. | 343/702 |
| 2007/0030197 A1 * | 2/2007 | Tsai et al. | 343/700 MS |

FOREIGN PATENT DOCUMENTS

| | | |
|---|---|---|
| EP | 1182727 A2 | 2/2002 |
| EP | 1475859 A1 | 11/2004 |
| JP | 2004048119 | 2/2004 |
| JP | 2004104333 | 4/2004 |
| JP | 2006-115089 | 4/2006 |
| JP | 2006-196994 | 7/2006 |
| JP | 2006-246070 | 9/2006 |
| WO | 2004038857 A1 | 5/2004 |

* cited by examiner

*Primary Examiner*—Trinh V Dinh
*Assistant Examiner*—Dieu Hien T Duong
(74) *Attorney, Agent, or Firm*—Barley Snyder, LLC

(57) ABSTRACT

An antenna having a ground plane having an edge and a first antenna element extending substantially parallel to the edge is disclosed. A ground element electrically connects the first antenna element with the ground plane. A second antenna element extends substantially parallel to the first antenna element and is disposed between the edge and the first antenna element and is connected at one end of the second antenna element to the first antenna element with the remaining end of the second antenna element located closer to the ground element. A third antenna element is disposed so that the first antenna element is between the second antenna element and the third antenna element and the third antenna element at extends substantially parallel to the first antenna element, with a rear end electrically connected with the first antenna element and a remaining end of the third antenna element is electrically open.

24 Claims, 12 Drawing Sheets

ANTENNA

CROSS-REFERENCE TO RELATED APPLICATION DATA

This application claims the benefit of the earlier filed JP Patent Application No. 2006-303832 having a filing date of Nov. 9, 2006.

FIELD OF THE INVENTION

The present invention relates to an antenna and, in particular, to an antenna with at least two resonant frequencies.

BACKGROUND

Electronic devices, such as laptop PCs, PDAs, and cellular phones, are equipped with antennas used for wireless communications with external devices. As development of multifunctional and compact electronic devices has progressed, antennas have to be more compact and have to support multiple frequency bands.

In this respect, a dual-band antenna is known. The dual-band antenna is equipped with a first antenna element of a folded monopole-type which is disposed between the feeding point and the ground point. The dual-band antenna is also equipped with a second antenna element branching off from the first antenna element at a point near the feeding point and extending separately from the first antenna element (see, for example, Japanese Patent Application Publication No. 2006-196994). This antenna supports two frequency bands as the first antenna element supports a first one of the two frequency bands and the second antenna element supports a second one of the two frequency bands. In addition, the impedance matching of the antenna with the transmitting and receiving circuits is accomplished by adjusting the shapes and dimensions of the first and the second antenna elements.

However, such a shape of the dual-band antenna—specifically, the shape with the second antenna element branching off from the first antenna element—makes it difficult to mount the antenna in a limited space.

SUMMARY

The present invention relates to, in one embodiment, an antenna having a ground plane having an edge and a first antenna element extending substantially parallel to the edge. A ground element electrically connects the first antenna element with the ground plane. A second antenna element extends substantially parallel to the first antenna element and is disposed between the edge and the first antenna element and is connected at one end of the second antenna element to the first antenna element with the remaining end of the second antenna element located closer to the ground element. A third antenna element is disposed so that the first antenna element is between the second antenna element and the third antenna element and the third antenna element at extends substantially parallel to the first antenna element, with a rear end electrically connected with the first antenna element and a remaining end of the third antenna element is electrically open.

BRIEF DESCRIPTION OF THE DRAWINGS

FIG. 12F is a left-side view showing an external appearance of the antenna shown in FIG. 9B.

DETAILED DESCRIPTION OF THE EMBODIMENTS

Hereinafter, an embodiment of an antenna according to the present invention will be given with reference to the drawings.

Figure 1:
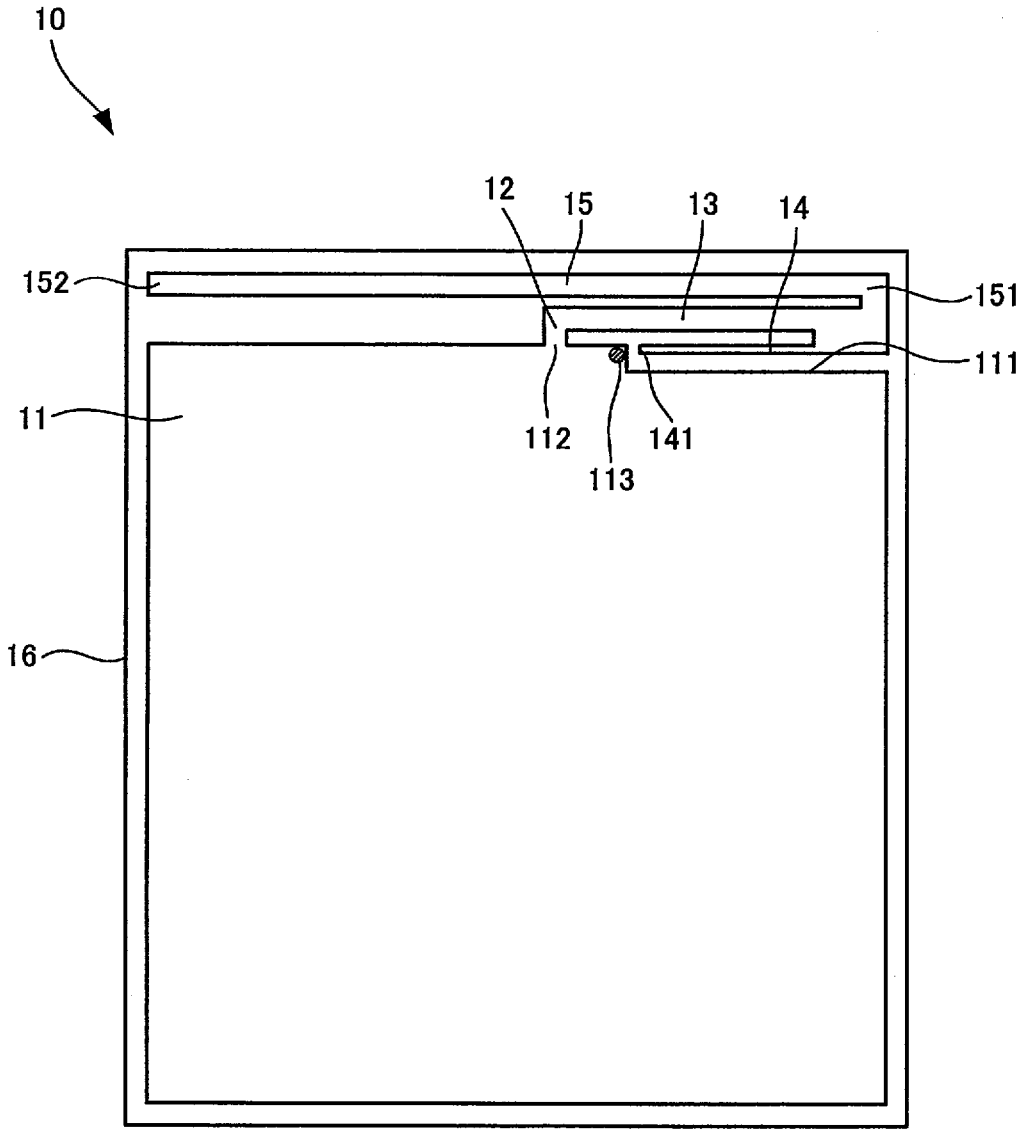
FIG. 1 is a view showing an external appearance of a planar antenna according to a first embodiment of the invention.

FIG. 1 shows an external appearance of a planar antenna according to a first embodiment of the invention.

A planar antenna 10 shown in FIG. 1 is a dual-band antenna that transmits and receives radio waves within two frequency bands, and has a first resonant frequency and a second resonant frequency. The planar antenna 10 of this embodiment is used for two frequency bands. A first frequency band includes a first operational frequency of approximately 850 MHz, which is near and slightly higher than the first resonant frequency while a second frequency band includes a second operational frequency of approximately 1950 MHz, which is near the second resonant frequency. The planar antenna 10 is constructed as a printed conductor pattern on a printed circuit board, and has a substantially rectangular shape. The planar antenna 10 comprises: a substantially planar, substantially rectangular ground plane 11, a ground element 12 that is contiguous to the ground plane 11, a first antenna element 13 that extends substantially linearly and contiguously to the ground element 12, a second antenna element 14 that extends substantially linearly and contiguously further to the first antenna element 13; and a third antenna element 15. These elements (the ground plane 11, the ground element 12, the first antenna element 13, the second antenna element 14, and the third antenna element 15) are integrally formed by etching a metal layer formed on a surface of a dielectric (substrate) 16 of the print circuit board.

The ground plane 11 has a straight edge 111, and the first antenna element 13 extends substantially parallel to the edge 111. The ground element 12 electrically connects a first end of the first antenna element 13 with the ground plane 11, and the point where the ground plane 11 and the ground element 12 are joined is named a ground joint point 112.

Each of the second antenna element 14 and the third antenna element 15 follow turned paths, turning by approximately 180°. The second antenna element 14 extends from a second end of the first antenna element 13, turns by approximately 180°, and then extends along a side of the first antenna element 13. Similarly, the third antenna element 15 extends from the same second end of the first antenna element 13, turns by approximately 180°, and then extends along an opposite side of the first antenna element 13.

The second antenna element 14 extends substantially parallel to the first antenna element 13 between the first antenna element 13 and the edge 111 of the ground plane 11. In the second antenna element 14, an end at a side closer to the ground element 12 is a feeding point 141 where the input signal is supplied. Meanwhile, the end of the second antenna element 14 opposed to the feeding point 141 is electrically connected with the first antenna element 13. The feeding point 141 is connected with the core wire of an unillustrated coaxial cable while the ground plane 11 is connected with the shield wire of the coaxial cable. The ground plane 11 has a shape such that a ground point 113 with which the shield wire is connected protrudes towards the feeding point 141. Because of the shape, the coaxial cable is attached so as to be directed in the same direction in which the second antenna element 14 extends, while the shield wire is connected with the ground point 113 that is the closest point within the ground plane 11 to the feeding point 141.

The third antenna element 15 is arranged in a position such that the first antenna element 13 is placed between the third antenna element 15 and the second antenna element 14. The third antenna element 15 extends substantially in parallel to the first antenna element 13. The end of the third antenna element 15 that is on the side where the third antenna element 15 turns back from the first antenna element 13 is referred to as a rear end 151. The rear end 151 is electrically connected with the second end of the first antenna element 13, which is the end of the first antenna element 13 opposed to the first end thereof where the first antenna element 13 is connected with the ground element 12. The end of the third antenna element 15 opposed to the rear end 151 is referred to as a leading end 152, and is an electrically open end.

The planar antenna 10 has the two resonant frequencies, referred to as a first resonant frequency and a second resonant frequency. In the planar antenna 10, the length of a route starting from the ground joint point 112, via the ground element 12, the first antenna element 13, and the third antenna element 15, and reaching the leading end 152 is referred to as a stub length. The planar antenna 10 is formed with the stub length equivalent approximately to a quarter of the wavelength of the first resonant frequency. In this embodiment, the first operational frequency is approximately 850 MHz and the first resonant frequency is made slightly lower than the first operational frequency. Accordingly, the stub length here is near and slightly longer than approximately 88 mm, which is a quarter of the wavelength approximately of 850 MHz.

In addition, with respect to a different route starting from the ground joint point 112, via the ground element 12 and the first antenna element 13, and reaching the turning-back point where the first antenna element 13 and the third antenna element 15 are joined together, the planar antenna 10 is formed so that the length of the above-mentioned different route is equivalent to approximately a quarter of the wavelength of the second resonant frequency of the planar antenna 10. In this embodiment, the second resonant frequency is substantially equal to the second operational frequency, that is, approximately 1950 MHZ. Accordingly, the route starting from the ground joint point 112, via the ground element 12 and the first antenna element 13, and reaching the joint point between the first antenna element 13 and the third antenna element 15 has a length approximately of 38 mm that is equivalent to approximately a quarter of the second operational wavelength. The third antenna element 15, in addition, is formed in a length of approximately a half of the wavelength of the second resonant frequency.

The planar antenna 10 has such a shape as to function both as an inverted-F antenna with the first resonant frequency and as a folded monopole antenna with the second resonant frequency. In the planar antenna 10, the elements that function as the inverted-F antenna with the first resonant frequency also function as the folded monopole antenna with the second resonant frequency, and are integrally formed. To put it another way, the planar antenna 10 is considered as an antenna in which the inverted-F antenna and the folded monopole antenna overlap each other, which will be described below in detail.

Figure 2A:
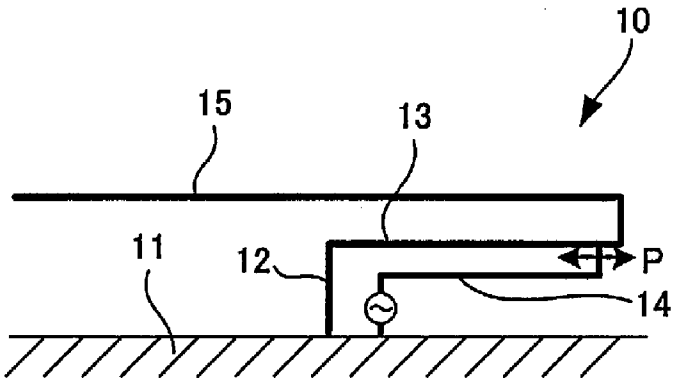
FIG. 2A is a diagram for describing a principle by which the planar antenna shown in FIG. 1 operates as an inverted-F antenna.
Figure 2B:
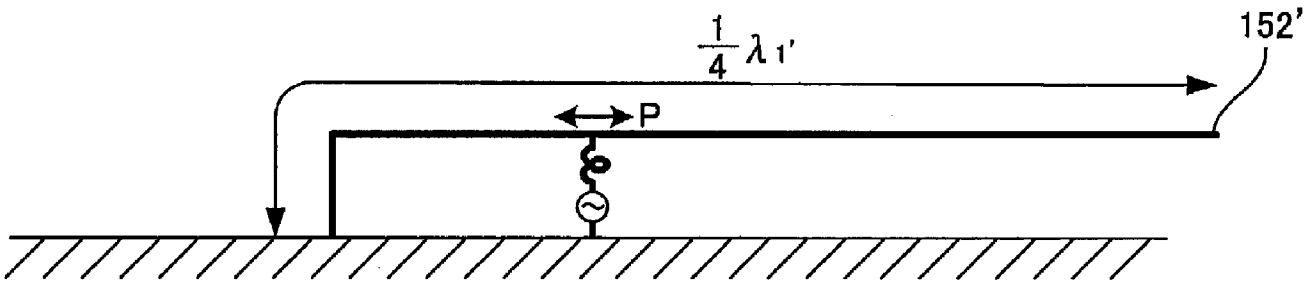
FIG. 2B is a diagram for describing an electrical equivalent of the antenna of FIG. 2A.

FIGS. 2A and 2B are diagrams for describing the principle by which the planar antenna shown in FIG. 1 operates as an inverted-F antenna. FIG. 2A shows, in a simplified manner, the planar antenna 10 including a signal source. FIG. 2B shows an inverted-F antenna that is electrically equivalent to the planar antenna 10 shown in FIG. 2A.

The structure of the planar antenna 10 shown in FIG. 1 can be understood in such a simplified manner as shown in FIG. 2A. In addition, in the structure shown in FIG. 2A, the third antenna element 15 that is folded back and extends from the first antenna element 13 is laid out on an extension line of the first antenna element 13, so that the structure shown in FIG. 2A can be substantially equivalent to the inverted-F antenna shown in FIG. 2B. In the structure shown in FIG. 2A, the second antenna element 14 functions as a feeding section for the inverted-F antenna, and the ground element 12 functions as a ground section for the inverted-F antenna. The resonant frequency of the planar antenna 10 shown in FIG. 2A is a frequency with a wavelength a quarter of which is equal to the stub length, the total combined length of the ground element 12, the first antenna element 13 and the third antenna element 15. The planar antenna 10 functioning as an inverted-F antenna has, at the resonant frequency, an impedance that is higher than 50Ω, which is the characteristic impedance of a standard transmission line. That is why the planar antenna 10 is used at the first operational frequency that is near and slightly higher than the resonant frequency.

In the planar antenna 10 functioning as an inverted-F antenna, the impedance is adjusted easily, as shown in FIG. 2A, by changing the position P where the second antenna element 14 is connected with the first antenna element 13. For example, as shown in FIG. 2B, as the connecting position of the feeding section is moved toward a leading end 152', the impedance of the antenna rises toward infinity. In contrast, as the connecting position P is moved toward the side opposed to the leading end 152', the impedance of the antenna falls down toward zero. In this embodiment, the first antenna element 13 is connected with the second antenna element 14 at a position such that the real part of the impedance at the first operational frequency (that is near and slightly higher than the resonant frequency) is 50Ω, which is a standard value (see FIG. 4). Additionally, in the planar antenna 10 functioning as an inverted-F antenna, the second antenna element 14 functions as a series inductance from the feeding point. Accordingly, the imaginary part of the impedance can be adjusted easily by changing the length of the second antenna element 14. In this embodiment, the second antenna element 14 has a length such that the imaginary part of the impedance at the first operational frequency is 0Ω (see FIG. 4).

While FIG. 2B shows a basic form of an inverted-F antenna, the planar antenna 10 shown both in FIG. 1 and FIG. 2A has a shape such that the second antenna element 14 is turned back and extends from the first antenna element 13. That is why the planar antenna 10 functions as an inverted-F antenna and, at the same time, as a folded monopole antenna.

Figure 3A:
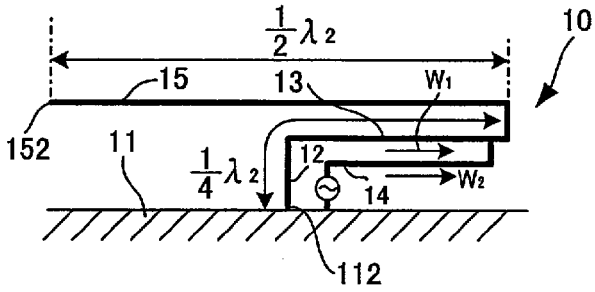
FIG. 3A is a diagram for describing a principle by which the planar antenna shown in FIG. 1 operates as a folded monopole antenna.
Figure 3B:
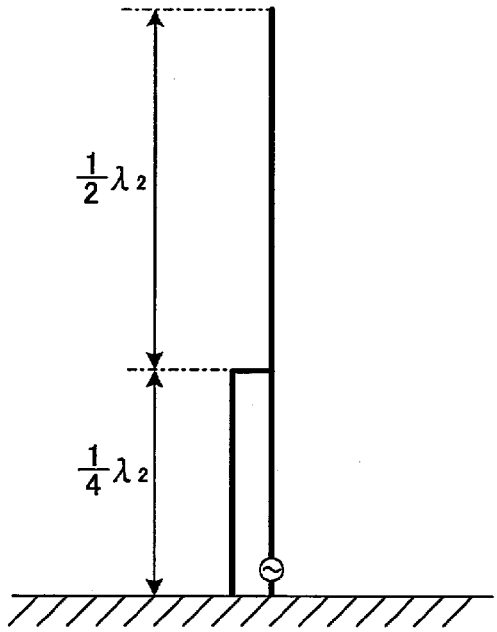
FIG. 3B is a diagram for describing an electrical equivalent of the antenna of FIG. 3A.
Figure 3C:
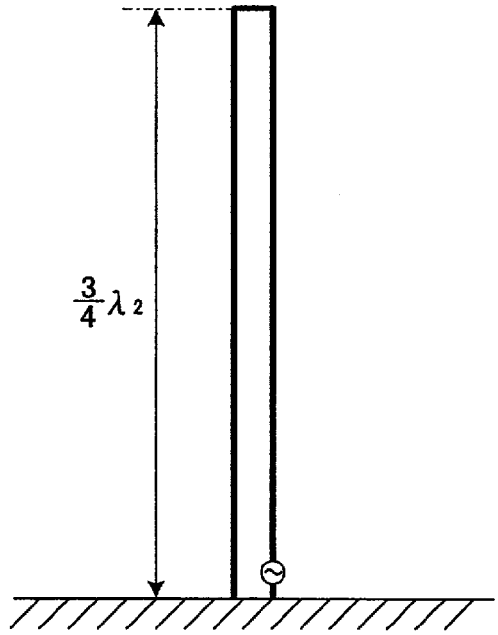
FIG. 3C is a diagram for describing another electrical equivalent of the antenna of FIG. 3A.

FIGS. 3A-3C are diagrams for describing the principle by which the planar antenna shown in FIG. 1 operates as a folded monopole antenna. FIG. 3A shows, in a simplified manner, the planar antenna 10 including a signal source. FIG. 3B and FIG. 3C each show a folded monopole antenna that is electrically equivalent to the planar antenna 10 shown in FIG. 3A.

In the structure of the antenna shown in FIG. 3B, the first antenna element 13, the second antenna element 14, and the third antenna element 15 are laid out so as to extend in a direction away from the ground plane 11. In addition, the structure shown in FIG. 3B is substantially equivalent to the basic monopole antenna shown in FIG. 3C. The resonant frequency of the planar antenna 10 shown in FIG. 3A is a frequency with a wavelength three quarters of which are equal to the stub length, the sum of the lengths of the ground element 12, the first antenna element 13, and the third antenna element 15. A folded monopole antenna, in general, can operate with a stub length that is equal to an integral multiple of a quarter of the wavelength at the resonant frequency, and the stub length in this embodiment is set at an odd multiple of a quarter of the wavelength at the resonant frequency, specifically, approximately three quarters of the wavelength at the resonant frequency. In addition, the length of the ground element 12 and the first antenna element 13 is equivalent to approximately a quarter of wavelength at the resonant frequency, and the length of the third antenna element 15 is equivalent to approximately two quarters, that is, approximately a half, of the wavelength at the resonant frequency. Moreover, in the planar antenna 10, the third antenna element 15 is turned back, by 180°, from the first antenna element 13. When a standing wave occurs in this planar antenna 10, the leading end 152 of the third antenna element 15 and the rear end 151, which is a half wavelength away from the leading end 152, become nodes of the standing wave of the electric current. Meanwhile, the ground joint point 112 between the ground element 12 and the first antenna element 13 becomes an anti-node of the standing wave of the electric current. In addition, the turning-back point to the second antenna element 14, which is a quarter wavelength away from the ground joint point 112, becomes a node of the standing wave of the electric current. For this reason, the standing current wave W1 of the first antenna element 13 is directed in the same direction as that of the standing current wave W2 of the second antenna element 14. Accordingly, the mutual inductance effect leads to higher impedance of the planar antenna 10 than a monopole antenna without folding. Incidentally, in the planar antenna 10 operating as a folded monopole antenna, the real part of the impedance can easily be adjusted by changing the thickness of the second antenna element 14 relative to the first antenna element 13. In this embodiment, the second antenna element 14 has a thickness such that the real part of the impedance at the second operational frequency is 50Ω, which is a standard value (see FIG. 4).

Figure 4:
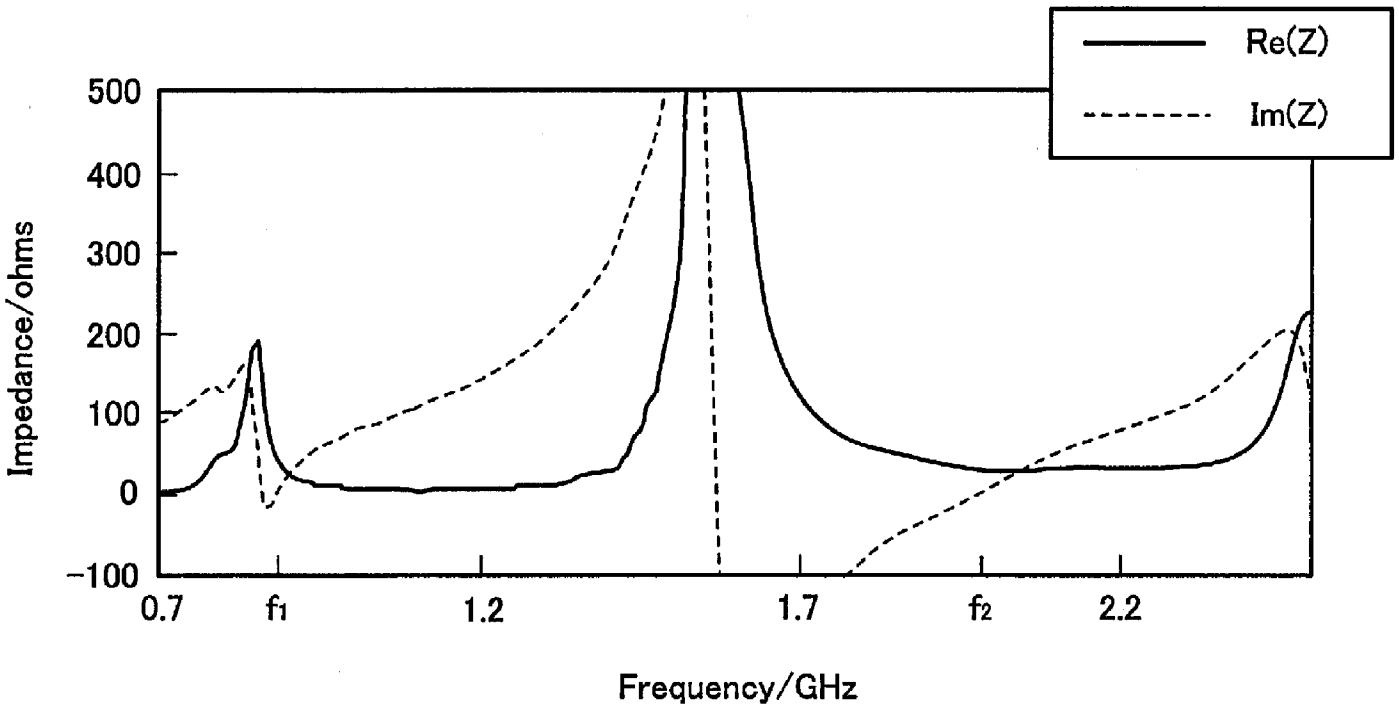
FIG. 4 is a graph showing the impedance characteristics of the planar antenna shown in FIG. 1.
Figure 5:
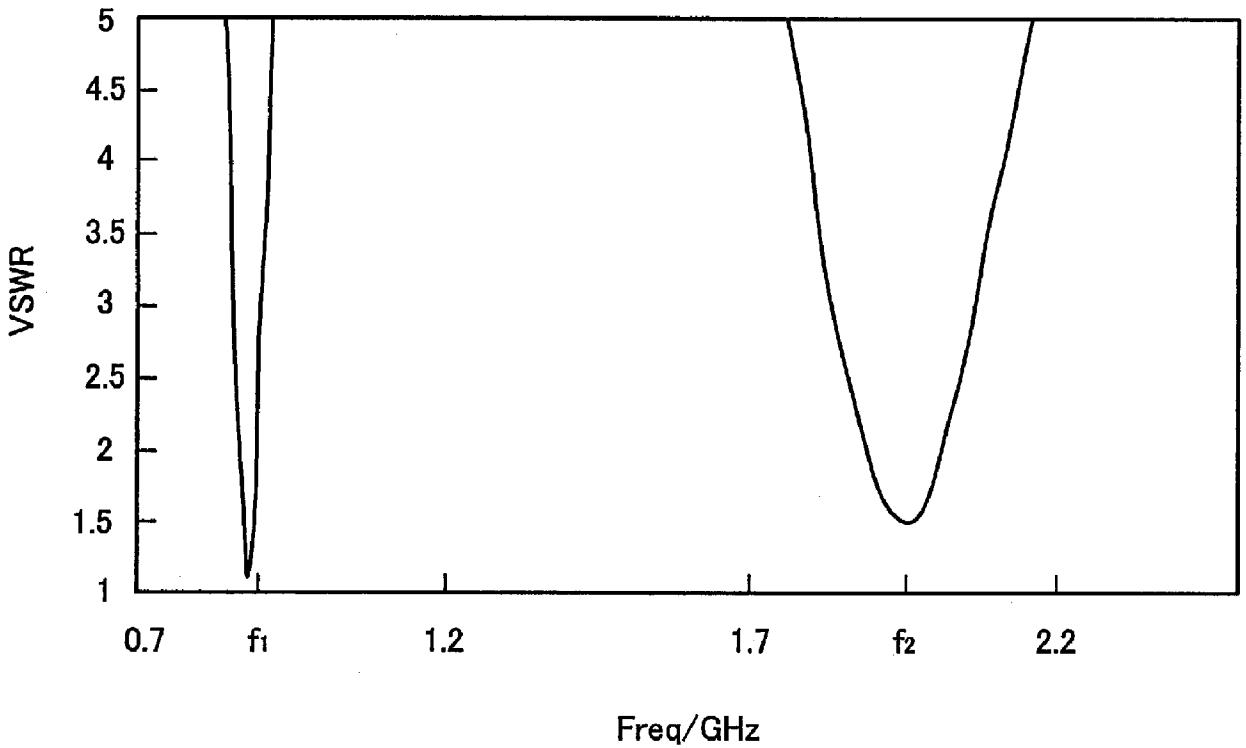
FIG. 5 is a graph showing the voltage standing wave ratio characteristics of the planar antenna shown in FIG. 1.

FIG. 4 is a graph showing the impedance characteristics of the planar antenna shown in FIG. 1. FIG. 5 is a graph showing the voltage standing wave ratio characteristics.

As FIG. 4 shows, in the impedance (Z) of the planar antenna 10, the real part Re(Z) and the imaginary part Im(Z) are adjusted to 50Ω and 0Ω, respectively, both near the first operational frequency f1 that is within the first frequency band and near the second operational frequency f2 that is within the second frequency band. In addition, as FIG. 5 shows, favorable voltage standing wave ratio (VSWR) characteristics are observed both near the first operational frequency f1 and near the second operational frequency f2.

The antenna 10 as a whole is made compact in size and is made suitable for use as a built-in type antenna that fits within a limited space. Further, since the inverted-F antenna differs from the folded monopole antenna in the position where the dimension and shape of the elements of the antenna 10 have to be changed to adjust the impedance, easy independent impedance adjustment of each of the inverted-F antenna and the folded monopole antenna is provided.

Subsequently a second embodiment of the present invention will be described. In the following descriptions, the descriptions are focused mainly on differences between the first and the second embodiments.

Figure 6:
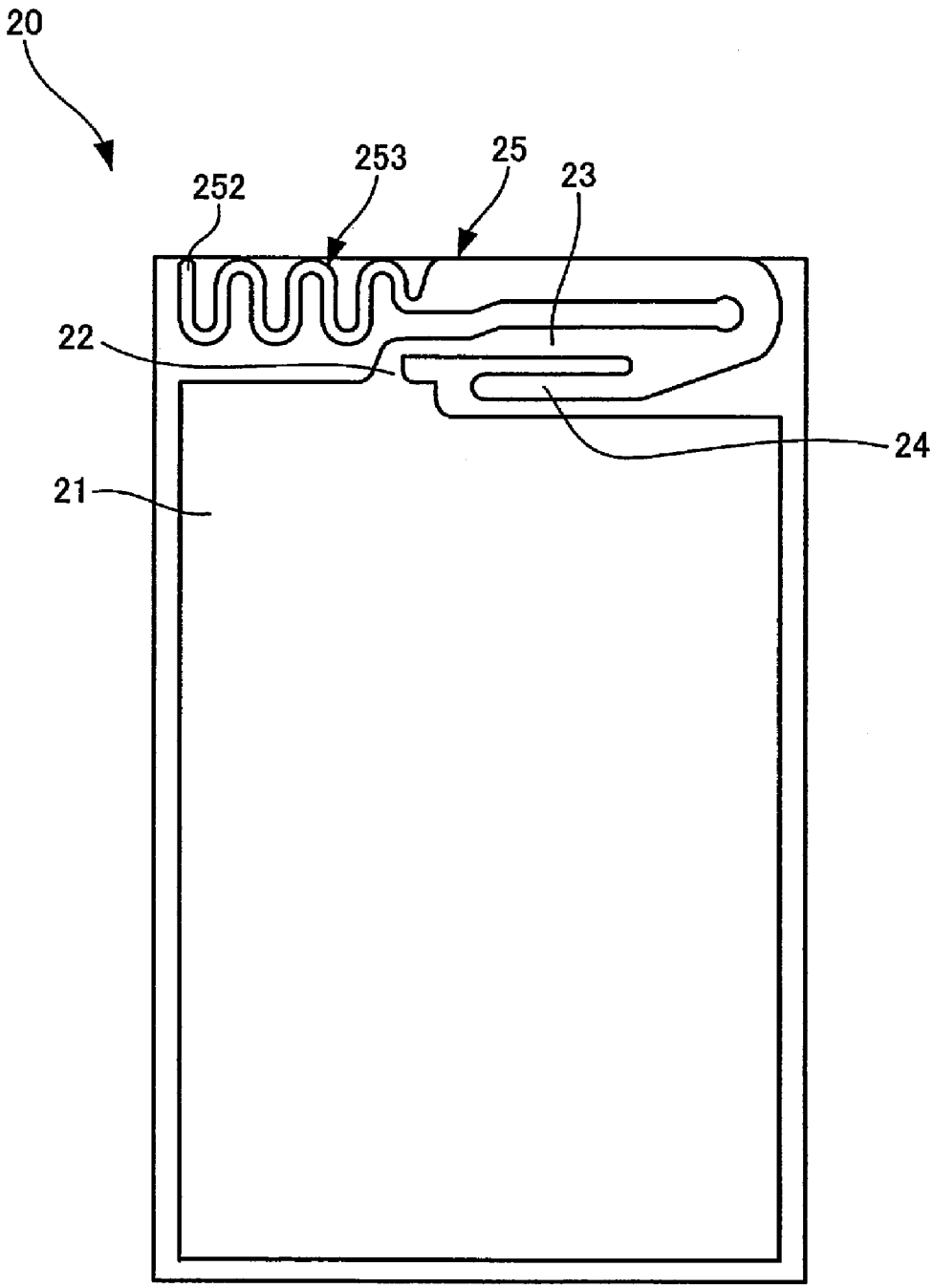
FIG. 6 is a view showing an external appearance of a planar antenna according to a second embodiment of the invention

FIG. 6 shows an external appearance of a planar antenna according to the second embodiment of the invention.

The planar antenna 20 shown in FIG. 6 is a dual-band antenna used in frequency bands, such as that of the wireless LAN, which are different from the frequency bands of the planar antenna 10 of the first embodiment. The planar antenna 20 includes a ground plane 21, a ground element 22, a first antenna element 23, a second antenna element 24, and a third antenna element 25. The basic configuration of the planar antenna 20 is similar to that of the planar antenna 10 of the first embodiment. Some of the differences between the planar antennas 20 and 10 are described hereafter. First, the dimensions of the elements differ because such dimensions need to reflect the resonant frequencies of the planar antennas 20 and 10. Second, the planar antenna 20 has its corners chamfered to obtain rounded corners for the purpose of reducing unnecessary reflection. Third, the planar antenna 20 has a meandering pattern 253 formed on the side of the leading end 252 of the third antenna element 25. Since a part of the third antenna element 25 is formed into the meandering pattern 253, the actual length (length of the route) of the third antenna element 25 is reduced from the electrical length. In the planar antenna 20 of this embodiment, since the wavelength compressing effect of the meandering pattern 253 is taken into consideration, the third antenna element 25 is formed so that the length (the actual length of the meandering route) of the third antenna element 25 is equivalent approximately to a half of the wavelength to be compressed.

Each of the planar antennas that have been described thus far is formed on only one of the sides of a wiring substrate. Now, descriptions will be given of a third embodiment of the invention in which elements are formed on both sides of a wiring substrate. In the following descriptions of the third embodiment, those elements that are common to the first embodiment will be given the same reference numerals, and only the differences between the third and the first embodiments will be described.

Figure 7:
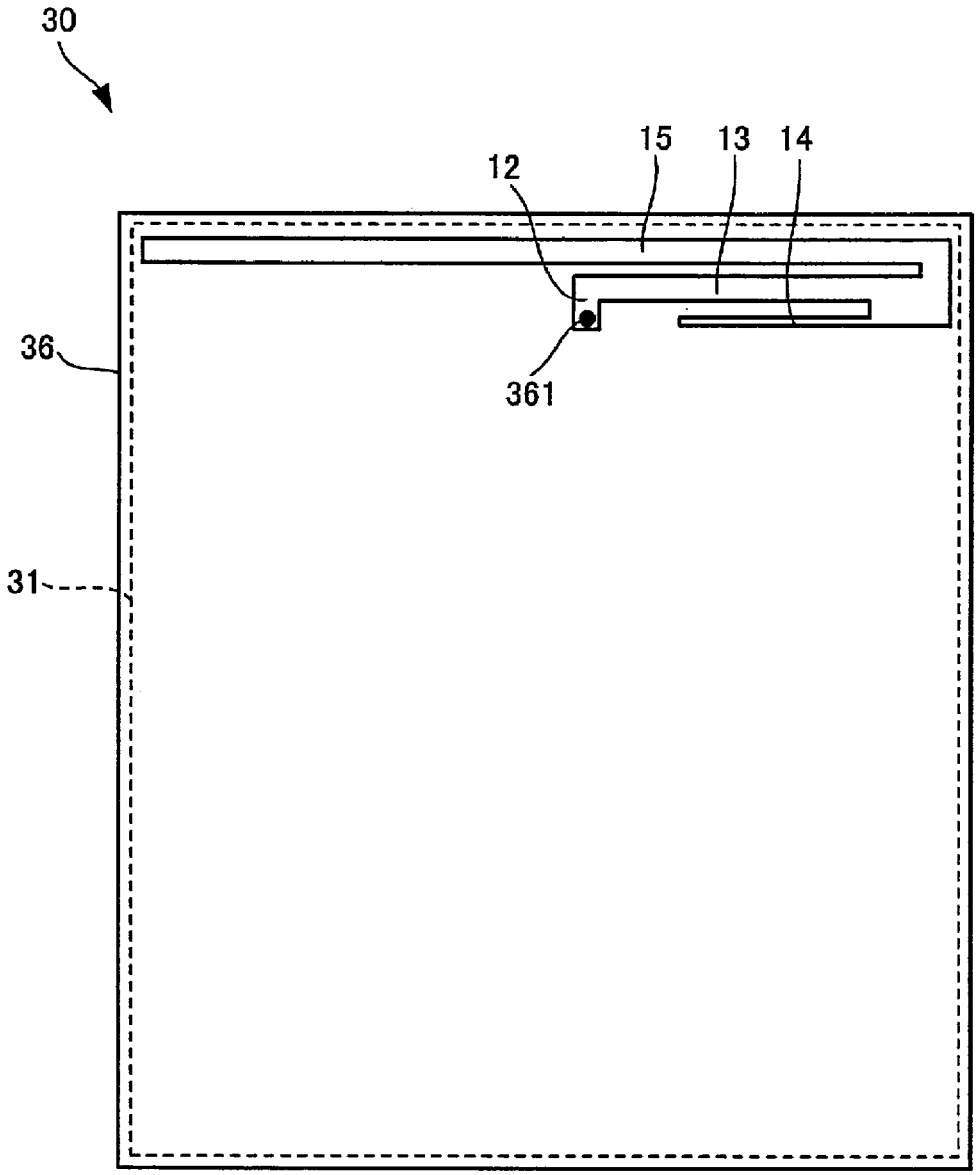
FIG. 7 is a view showing an external appearance of a planar antenna according to a third embodiment of the invention.

FIG. 7 shows an external appearance of a planar antenna according to the third embodiment of the invention.

A planar antenna 30 shown in FIG. 7 differs from the planar antenna 10 of the first embodiment in that a ground plane 31 is formed on a surface of a substrate 36 while other elements are formed on the opposite surface of the substrate 36. A ground element 12, and first, second, and third antenna elements 13, 14, 15 are formed substantially in parallel with the ground plane 31 with the substrate 36 (having a substantially flat-plate shape) being interposed therebetween. The ground element 12 and the ground plane 31 are electrically connected with each other by a hole formed so as to penetrate the substrate 36. Like the planar antenna 10 of the first embodiment, the planar antenna 30 shown in FIG. 7 functions as a dual-band antenna.

Each of the planar antennas that have been described thus far is formed only on a surface of a wiring substrate. Now, descriptions will be given of a fourth embodiment of the invention with a three-dimensional structure. In the following descriptions of the fourth embodiment, the differences between the fourth and the first embodiments will mainly be described.

Figure 8:
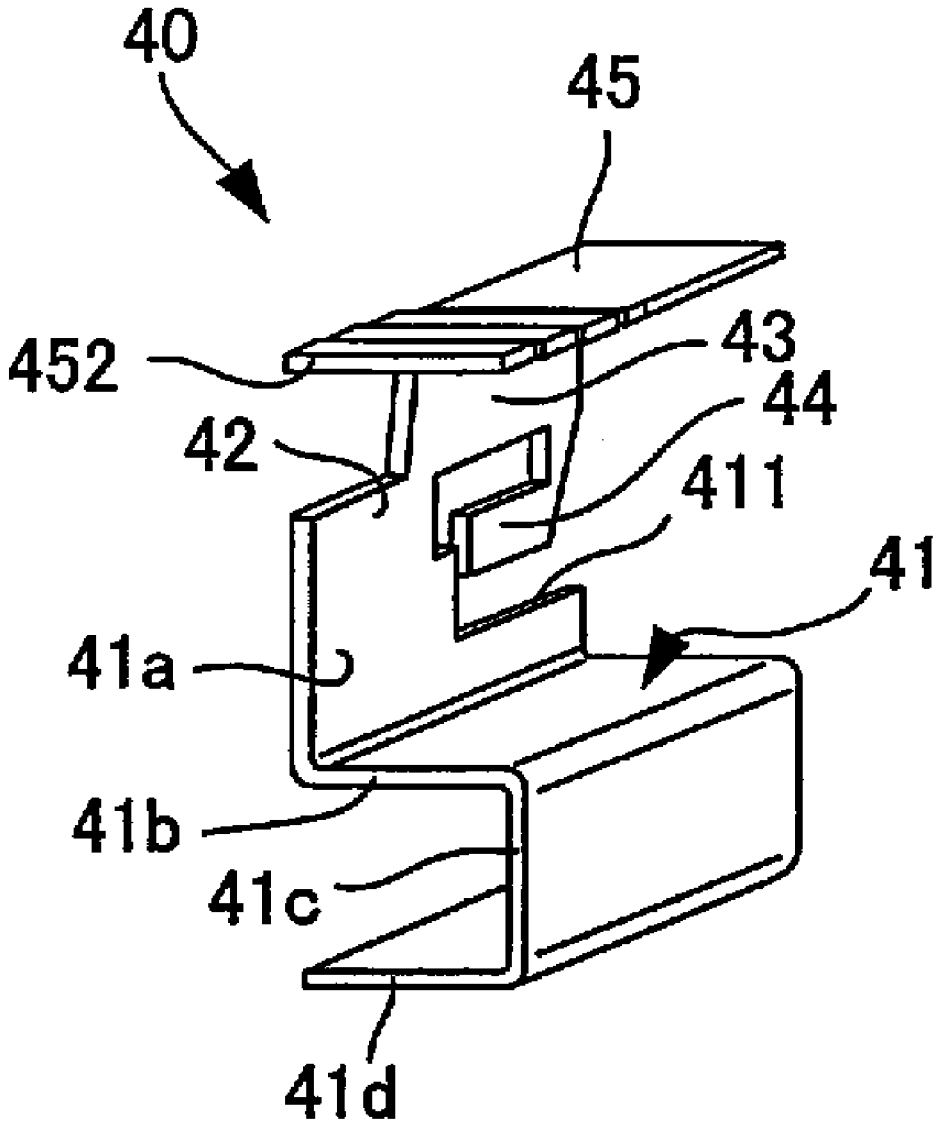
FIG. 8 is a perspective view showing an external appearance of an antenna according to a fourth embodiment of the invention.
Figure 9A:
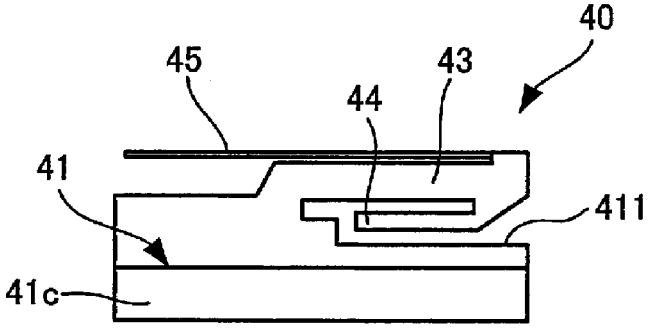
FIG. 9A is a projection view showing an external appearance of the antenna shown in FIG. 8.
Figure 9B:
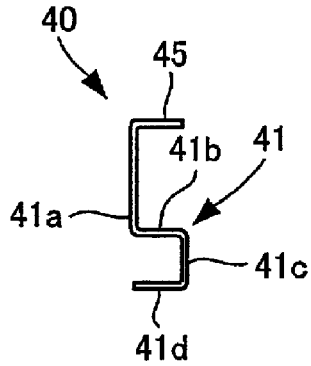
FIG. 9B is another projection view showing an external appearance of the antenna shown in FIG. 8.

FIGS. 8, 9A, and 9B show a fourth embodiment of the invention, an antenna 40 that is a dual-band antenna with two resonant frequencies within a frequency range from 2 GHz to 6 GHz. The antenna 40 is integrally formed by punching and bending a metal plate. The planar antenna 40 comprises a ground plane 41 with a straight edge 411, a ground element 42 that is contiguous to the ground plane 41, a first antenna element 43 that extends contiguously to the ground element 42 and substantially in parallel with the edge 411, a second antenna element 44 that extends contiguously to the first antenna element 43, substantially in parallel with the first antenna element 43, and between the edge 411 and the first antenna element 43, and a third antenna element 45 that has a part extending substantially in parallel with the first antenna element 43 such that the second antenna element 44 is formed between the first antenna element 43 and the third antenna element 45. The basic configuration of the antenna 40 is common to the planar antenna 10 of the first embodiment.

The antenna 40 shown in FIG. 8, however, differs from the planar antenna 10 of the first embodiment in both the way the antennas 40 and 10 are fabricated and in the following ways. First, the third antenna element 45 in the antenna 40 is folded so as to be substantially perpendicular to the first antenna element 43 and the second antenna element 44. Second, a part of the third antenna element 45 on the side of a leading end 452 is formed in a meandering pattern. Third, the ground plane 41 is bent at three positions and thus has four separate planes 41*a*, 41*b*, 41*c*, and 41*d*. Among these four planes 41*a* to 41*d*, the plane 41*d* is formed substantially in a perpendicular manner to the first antenna element 43 and the second antenna element 44, each of which is formed in a plate shape. The plane 41*d* is fixed to a chassis of an electronic device. Hereinafter, the plane 41*d* is referred to as a facing plane 41*d*.

Figure 10A:
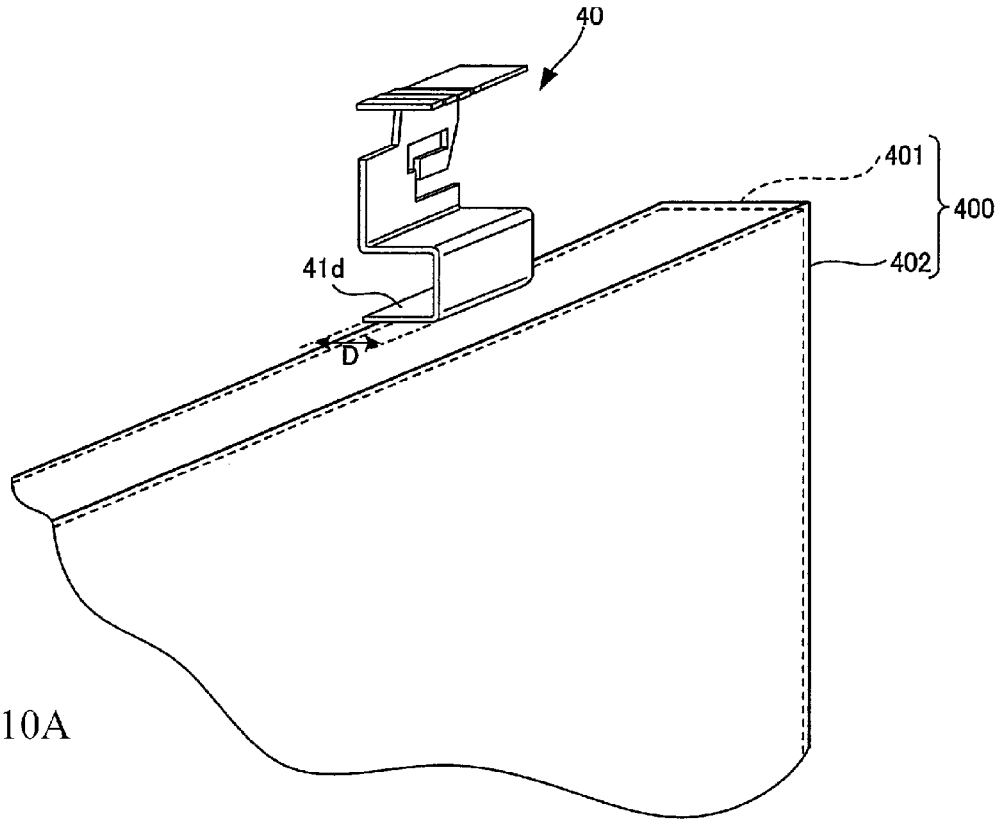
FIG. 10A is a perspective view illustrating the state in which the antenna shown in FIG. 8 is used.
Figure 10B:
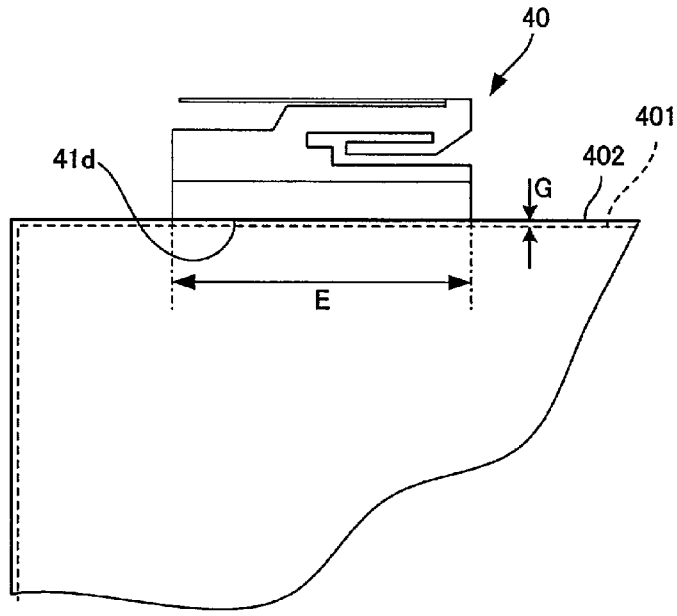
FIG. 10B is a projection view illustrating the state in which the antenna shown in FIG. 8 is used.

FIG. 10 is a perspective view illustrating the state in which the antenna shown in FIG. 8 is used.

As shown in FIG. 10, the antenna 40 is attached to a chassis 400 of an electronic device, such as a laptop PC and a PDA. The chassis 400 of the electronic device shown in FIG. 10 includes a metal chassis frame 401 and a cover 402 made of an insulating material that covers the entirety of the chassis frame 401. The metal chassis frame 401 is an example of a metal portion included in the chassis 400 to which the antenna of the invention is attached. When the antenna 40 is attached to the chassis 400, the chassis frame 401 functions as an extension portion of the ground plane 41. Consequently, the antenna 40 maintains its favorable performance in spite of the small ground plane 41 that the antenna 40 has. As a consequence, the compact antenna 40 may have a small ground plane 41 without causing undue performance loss.

The antenna 40 is attached by making the facing plane 41*d* face the chassis frame 401 inside the chassis 400. As has been described above, the cover 402 made of an insulating material covers the chassis 400, so that the antenna 40 is not in contact with the chassis frame 401. The antenna 40, however, is attached with its facing plane 41*d* of the ground plane 41 facing the chassis frame 401 inside the chassis 400, so that the ground plane 41 is capacitively coupled with the chassis frame 401. As a consequence, the chassis frame 401 inside the chassis 400 functions as an extension portion of the ground plane 41. For example, when the facing plane 41*d* has an 18 mm width E, the facing plane 41*d* has a depth of approximately 3 mm or more. In addition, a clearance G of 1.5 mm or less between the chassis frame 401 and the facing plane 41*d* allows the chassis frame 401 to function sufficiently as an extension portion of the ground plane 41. Furthermore, the facing plane 41*d* is formed substantially perpendicular to a plane including both the first and the second antenna elements 43 and 44. Accordingly, attaching the antenna 40 with the facing plane 41*d* facing the chassis frame 401 allows the antenna 40 to take such an attitude that a sufficient clearance is secured between the first antenna element 43, the second antenna element 44, and the chassis frame 401.

Figure 11:
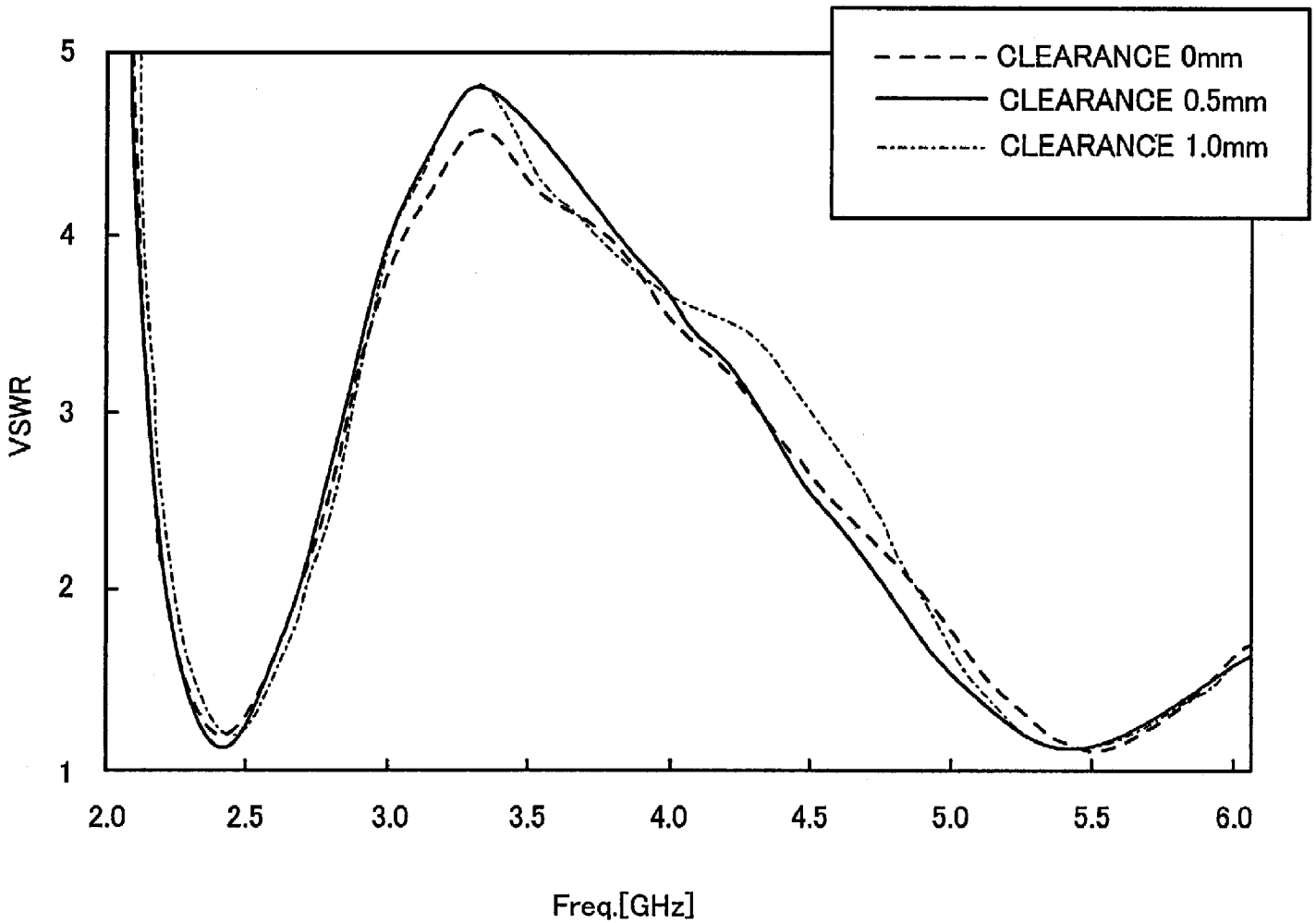
FIG. 11 is a graph showing the voltage standing wave ratio characteristics of the antenna shown in FIG. 10 in a state where the antenna is attached to the chassis.
Figures 12, 12A, 12B, 12C, 12D, 12E:
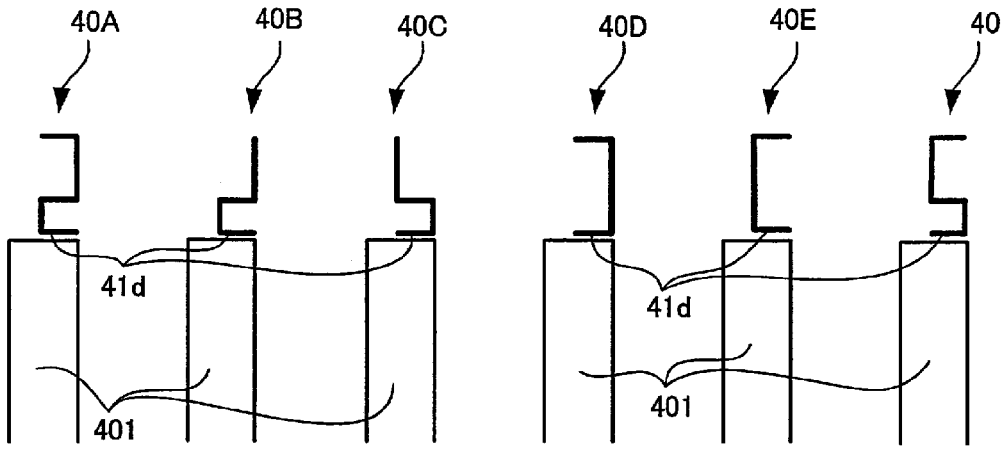
FIG. 12A is a left-side view showing an external appearance of a modified example of the antenna shown in FIG. 8.
FIG. 12B is a left-side view showing an external appearance of another modified example of the antenna shown in FIG. 8.
FIG. 12C is a left-side view showing an external appearance of another modified example of the antenna shown in FIG. 8.
FIG. 12D is a left-side view showing an external appearance of another modified example of the antenna shown in FIG. 8.
FIG. 12E is a left-side view showing an external appearance of another modified example of the antenna shown in FIG. 8.

FIG. 11 is a graph showing the voltage standing wave ratio (VSWR) characteristics of the antenna shown in FIG. 10 in a state where the antenna is attached to the chassis.

FIG. 11 shows the characteristics in a state where the antenna takes the position shown in FIG. 10 and a 0.5 mm clearance G exists between the chassis frame 401 and the facing plane 41*d* as well as in a state where the antenna takes the position shown in FIG. 10 and a 1.0 mm clearance G exists between the chassis frame 401 and the facing plane 41*d*. In addition, the characteristics in a state where the chassis frame 401 and the facing plane 41*d* are in contact with each other, that is, a 0 mm clearance G exists in between, are also shown in FIG. 11 as a comparative example. FIG. 11 shows that, favorable voltage standing wave ratio characteristics are obtained in two operational frequency bands both in the state where the clearance G is 0.5 mm and in the state where the clearance G is 1.0 mm, as well as in the case of the state where the chassis frame 401 and the facing plane 41*d* are electrically connected with each other (G=0 mm).

Subsequently, modified examples of the fourth embodiment will be described. In each of the modified examples, the ground plane is bent in directions and at positions different from the ground plane of the antenna of the fourth embodiment.

FIGS. 12A-12E are left-side views showing external appearances of various antennas of the modified examples of the fourth embodiment of the invention. FIGS. 12A-12E are left-side views showing, together with chassis frame 401, five antennas 40A-40E each of which differs from the antenna 40 shown in FIGS. 8 and 9 in the folding directions and positions of the ground plane. FIG. 12F shows, for a comparative purpose, the antenna 40 that of FIG. 9B. Note that covers 402 that cover the chassis frames 401 are omitted in FIGS. 12A-12F.

As shown in FIG. 12A-12E, each of the antennas 40A-40E of the modified examples has a facing plane 41*d*, which faces the chassis frame 401 inside the chassis 400, and which is formed by bending the ground plane 41. With the facing plane 41*d*, the ground plane 41 is capacitively coupled with the chassis frame 401 as in the case of the antenna 40 shown in FIGS. 8 and 9, and thus the chassis frame 401 is capable of functioning as an extension portion of the ground plane 41.

Several embodiments of the present invention have been described thus far, but the present invention is not limited to these embodiments.

Though the examples that have been described in the above embodiments are of dual-band antennas, the present invention is not limited to the dual-band antennas. For example, the present invention is applicable to an antenna with three or more resonant frequencies by additional elements.

What is claimed is:

1. An antenna, comprising:

a ground plane having an edge;

a first antenna element extending substantially parallel to the edge;

a ground element that electrically connects the first antenna element with the ground plane;

a second antenna element extending substantially parallel to the first antenna element and disposed between the edge and the first antenna element, the second antenna element connected at one end of the second antenna element to the first antenna element and turning back approximately 180° to extend substantially beside the first antenna element, the remaining end of the second antenna element being physically separated from the first antenna element and located closer to the ground element than the end of the second antenna element connected to the first antenna element; and a third antenna element disposed so that the first antenna element is between the second antenna element and the third antenna element, the third antenna element at least partially extending substantially parallel to the first antenna element, the third antenna element having a rear end electrically connected with the first antenna element at an end of the first antenna element that opposes the end of the first antenna element that is connected to the ground element, the remaining end of the third antenna element being electrically open.

2. The antenna according to claim 1, wherein the end of the second antenna element located closer to the ground element is a feeding point for receiving an input signal.

3. The antenna according to claim 1, wherein the combined length of the ground element, the first antenna element, and the third antenna element is equal to approximately one quarter of the wavelength of a first resonant frequency of the antenna.

4. The antenna according to claim 3, wherein the combined length of the ground element and the first antenna element is equal to approximately one quarter of the wavelength of a second resonant frequency of the antenna.

5. The antenna according to claim 4, wherein the length of the third antenna element is approximately one half of the wavelength of the second resonant frequency.

6. The antenna according to claim 5, wherein an imaginary part of an impedance of the antenna when operating the antenna at a first operational frequency associated with the first resonant frequency is variable by adjusting the length of the second antenna element.

7. The antenna according to claim 6, wherein a real part of an impedance of the antenna when operating the antenna at a second operational frequency associated with the second resonant frequency is variable by adjusting a thickness of the second antenna element relative to a thickness of the first antenna element.

8. The antenna according to claim 7, wherein the third antenna element extends from the first antenna element and turns back approximately 180° to extend substantially beside the first antenna element.

9. The antenna according to claim 7, wherein the ground plane has a substantially planar shape.

10. The antenna according to claim 9, wherein the first operational frequency is approximately 850 MHz.

11. The antenna according to claim 9, wherein the second operational frequency is approximately 1950 MHz.

12. The antenna according to claim 1, wherein at least one corner of at least one of the ground element, the first antenna element, the second antenna element, and the third antenna element is chamfered.

13. The antenna according to claim 1, wherein the third antenna element comprises a meandering pattern.

14. The antenna according to claim 1, wherein each of the ground plane, the ground element, the first antenna element, the second antenna element, and the third antenna element are formed on the same side of a substrate.

15. The antenna according to claim 1, wherein the ground plane is formed on a side of the substrate and each of the ground element, the first antenna element, the second antenna element, and the third antenna element are formed on an opposing side of a substrate.

16. The antenna according to claim 15, wherein the ground plane is connected to the ground element by a hole formed in the substrate.

17. The antenna according to claim 1, the ground plane further comprising:

a substantially planar facing plane for capacitively coupling the ground plane to a metal portion of the chassis of an electronic device.

18. The antenna according to claim 17, wherein the ground plane is substantially perpendicular to a plane along which each of the first antenna element and the second antenna element lie.

19. The antenna according to claim 17, wherein the third antenna element lies substantially parallel to the facing plane.

20. The antenna according to claim 19, wherein the third antenna element comprises a meandering pattern.

21. The antenna according to claim 17, wherein the facing plane directly contacts the metal portion of the chassis of the electronic device.

22. The antenna according to claim 17, wherein the facing plane is offset from the metal portion of the chassis of the electronic device.

23. The antenna according to claim 17, wherein the ground plane is bent at three different positions resulting in the ground plane comprising four different planes.

24. The antenna according to claim 17, wherein the antenna is resonant at two resonant frequencies each of the two resonant frequencies having a value between about 2 GHz and about 6 GHz.

* * * * *